United States Patent [19]

Hamada et al.

[11] 4,347,948

[45] Sep. 7, 1982

[54] CONTAINER FOR FILLING IN LIQUID

[75] Inventors: Minoru Hamada, Kawanishi; Nobuyuki Nakamura, Takatsuki; Akira Odajima, Ibaraki, all of Japan

[73] Assignee: Nippon Paint Co., Ltd., Osaka, Japan

[21] Appl. No.: 196,052

[22] PCT Filed: Aug. 29, 1979

[86] PCT No.: PCT/JP79/00229

§ 371 Date: Mar. 31, 1980

§ 102(e) Date: Mar. 31, 1980

[87] PCT Pub. No.: WO80/00431

PCT Pub. Date: Mar. 20, 1980

[30] Foreign Application Priority Data

| | | | |
|---|---|---|---|
| Aug. 31, 1978 | [JP] | Japan | 53-107302 |
| Nov. 1, 1978 | [JP] | Japan | 53-135487 |
| May 29, 1979 | [JP] | Japan | 54-67014 |

[51] Int. Cl.[3] ..... B65D 25/16

[52] U.S. Cl. ..... 220/404; 220/5 R; 220/378; 220/461

[58] Field of Search ..... 220/403, 404, 460, 461, 220/466, 462, 5 R, 378; 229/5.7

[56] References Cited

U.S. PATENT DOCUMENTS

| | | | |
|---|---|---|---|
| 1,169,606 | 1/1916 | Blank et al. | 220/404 X |
| 1,575,681 | 3/1926 | Griffiths | 220/461 |
| 2,025,932 | 12/1935 | Beldin | 220/404 |
| 2,065,293 | 12/1936 | Scudder | 220/404 |
| 2,083,491 | 6/1937 | Chaffee | 220/461 X |
| 2,128,297 | 8/1938 | Ingersoll | 220/466 X |
| 2,989,208 | 6/1961 | Gibbs, Jr. | 229/5.7 X |
| 3,065,895 | 11/1962 | Lipschultz et al. | 220/403 |
| 3,101,839 | 8/1963 | Holman | 220/403 X |
| 3,167,209 | 1/1965 | Jones | 220/461 |
| 3,169,690 | 2/1965 | Scholle | 220/403 |
| 3,468,451 | 9/1969 | Coleman | 220/404 X |
| 3,940,052 | 2/1976 | McHugh | 220/404 |
| 4,101,045 | 7/1978 | Roberts et al. | 220/404 |
| 4,171,751 | 10/1979 | Schutz | 220/466 |

FOREIGN PATENT DOCUMENTS

| | | | |
|---|---|---|---|
| 1210381 | 2/1966 | Fed. Rep. of Germany | 220/461 |
| 662970 | 8/1929 | France | 220/461 |
| 648863 | 1/1951 | United Kingdom | 220/403 |

*Primary Examiner*—Allan N. Shoap

*Attorney, Agent, or Firm*—Wenderoth, Lind & Ponack

[57] ABSTRACT

The invention is related to a container for holding liquids such as a 200 liter removable head steel drum. The drum is provided with an inner bag which lines the inside periphery of the drum and thereby prevents the sealing or coating liquid contained or being dumped into the drum from contacting the inside periphery of the drum. The inner bag is disposable. Thus the drum can be recycled or regenerated for reuse at a reasonable cost. Further, the inner bag prevents the liquid from being contaminated by the foreign matter located on the drum inner surface. The inner bag is removably fitted to the inside of the drum by a fixing means. The fixing means is removably fitted to at least one annular recess normally present on the inside periphery of the drum with or without the presence of the inner bag disposed between the recess and the fixing means. The fixing means fixes the inner bag and prevents it from slipping out while the liquid filled drum is being shipped or carried about or while the liquid inside the drum is being stirred or dumped from the drum. For the regeneration of the drum, the used inner bag is simply removed and replaced with a new one.

5 Claims, 16 Drawing Figures

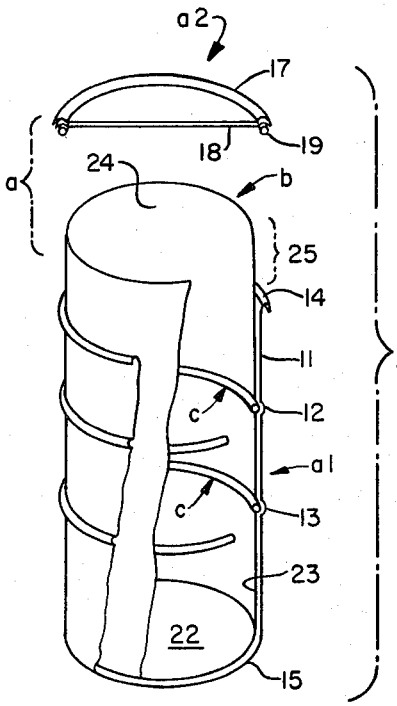
FIG. 1.
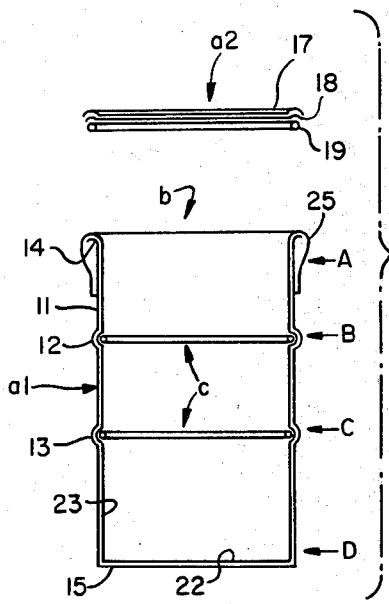
FIG. 2.
FIG. 4a.
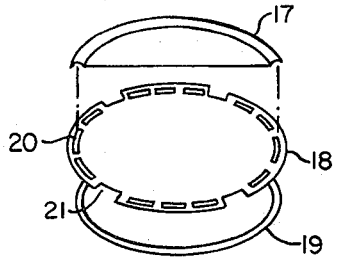
FIG. 4b.
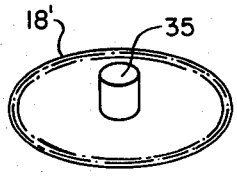
FIG. 4c.
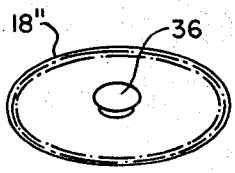
FIG. 7a.
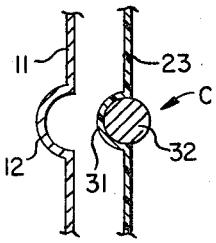
FIG. 7b.
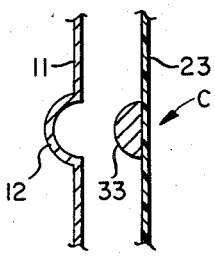
FIG. 7c.
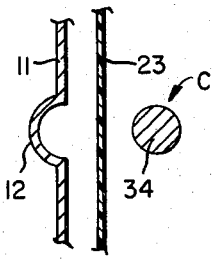

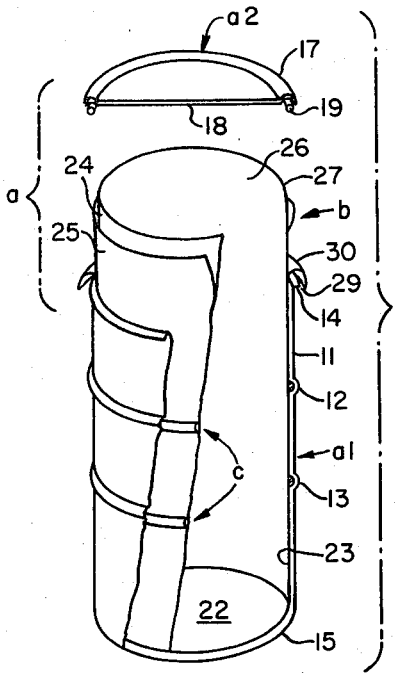
FIG. 5.
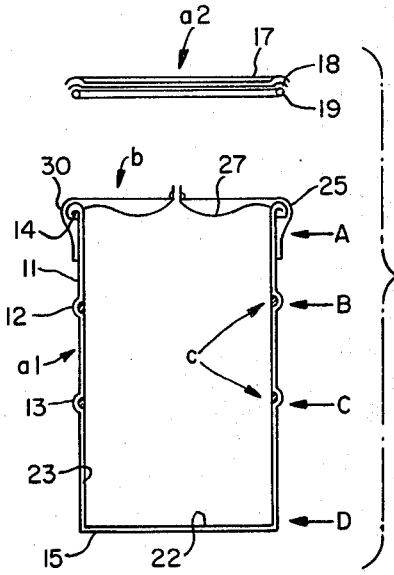
FIG. 6.
FIG. 8a.
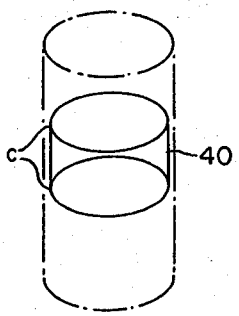
FIG. 8b.
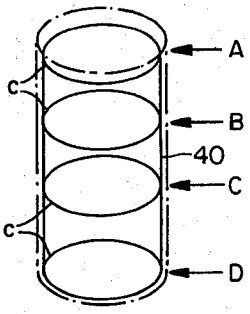
FIG. 8c.
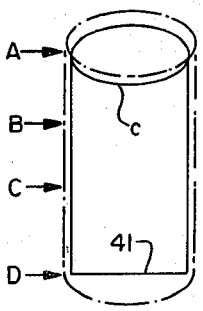
FIG. 8d.
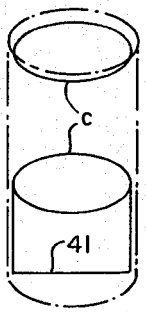
FIG. 3.
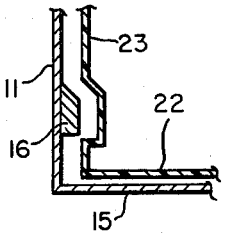
FIG. 9.
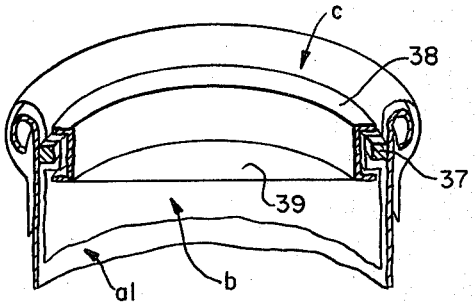

CONTAINER FOR FILLING IN LIQUID

BACKGROUND OF THE INVENTION

The present invention relates to a container for holding liquid, and more particularly to a container having an inner bag useful for preventing the inside surface of the container from being soiled by the liquid and preventing the liquid therein from being contaminated by foreign matters from within the container.

Often times 200 liter removable head steel drums have been used as the containers for holding for example a liquid coating composition. Generally, these drums are regenerated after use and offered for re-use. During regeneration, the drum is required to undergo processes in the following order:

1. burning of the residual deposit of coating composition
2. cleaning of the surface by shot blast, etc.
3. removing any deformation of the drum
4. re-coating, the regeneration thus requiring many steps and large costs. In order to solve these problems and for preventing the mixing of foreign matters with the coating composition in the drum and for preventing any change in the quality of the coating composition itself, there have hitherto been used disposable inner bags of plastic films like polyethylene or polypropylene. In the case of the use of an inner bag having simply a tubular form, the inner bag containing the coating composition is apt to slide down in the container during the course of filling, carrying, or stirring or removing the coating composition for use, etc., because of which the original function of the inner bag is lost. To overcome these defects, attempts have been made to use a thicker material for the inner bag to provide a self-sustaining property thereto or to turn a part of the inner bag back down over the outside of the container at the opening of the container. From the viewpoint of the desirability of using a disposable inner bag, however, neither of these attempts has provided satisfactory effects from either the technical or economical viewpoint.

An object of the present invention is to provide a container lined with an inner bag which can prevent the inside surface of the container from being soiled with the liquid contained therein by spilling out of the inner bag during filling a liquid, such as a coating composition or an ink, into the container, carrying, or using the container.

Another object of the present invention is to provide a container lined with an inner bag which the inner bag per se can contain the liquid in a sealed state and which can prevent foreign matter from mixing in said liquid and prevent any change in quality of the liquid.

A further object of the present invention is to provide, by a combination of the inner bag and the container provided with the above characteristics, a container lined with an inner bag, said inner bag having an easy-to-manufacture, simple construction to meet the object of disposal after use.

SUMMARY OF THE INVENTION

According to the present invention, there is provided a container for holding liquid including a container, an inner bag, and one or more fixing means between them, respectively comprising the following:

(a) The container comprises a bottomed container body which has at least one annular or non-annular projection or recess running along the circumferential surface of the inside face of its outer periphery with its one end face opened, serving as a container opening, and a lid body which can be removably fitted in an air-tight state, to the opening of the container body and which has a plastic film sheet removably fixed to its entire inside face.

(b) The inner bag is made of a plastic film tubular shaped bottomed bag which can be removably set in the container body and with an open end thereof substantially protruding from the opening of the container body when the bag is set in it, so that at least one protruding layer portion can be turned down over the outer periphery of the barrel of the container body.

(c) The fixing means is a member for fixing the inner bag inside the container body, said member being removably fitted to at least one projection or recess of the container body with or without the presence of the inner bag therebetween. The means can be fixed to the outside of the inner bag or it can be an independent member situated inside and abutting the inside periphery of the inner bag or it can be fixed to the inside periphery of the inner bag.

BRIEF DESCRIPTION OF DRAWINGS

These and other features of the present invention will be more clearly explained in view of the appended drawings, in which:

FIG. 1 is a partially cutaway and simplified perspective view showing a preferred embodiment of the present invention.

FIG. 2 is a vertical sectional view of the preferred embodiment of the present invention showing the condition where the protruding portion is turned down over the outside of the barrel part.

FIG. 3 is a simplified cross-section view of the preferred embodiment showing the bottom parts of the inner bag and the container.

FIGS. 4(*a*) to (*c*) are the simplified perspective views showing respectively three embodiments of the plastic film sheet to be fixed to the lid body.

FIG. 5 is a partially cutaway and simplified perspective view showing another embodiment of the present invention.

FIG. 6 is a view like FIG. 2 except with respect to the other embodiment in FIG. 5.

FIGS. 7(*a*) to (*c*) are simplified cross-sectional views of the present invention illustrating the relationship between the recess of the barrel of the container and the fixing means, respectively.

FIGS. 8(*a*) to (*d*) are respectively the diagrammatic views illustrating the mutual connections or the supporting conditions of the independent fixing means of the present invention.

FIG. 9 is a partial simplified perspective view of another embodiment showing the relationships between the projection of the barrel of the container and the fixing means.

DETAILED DESCRIPTION

Referring now to the drawings, in FIG. 1 and FIG. 2, there is shown a container $a_1$ and a lid $a_2$. The body $a_1$ of the embodiments described herein is an ordinary full removable head steel drum (200 l). The drum ordinarily has substantially semi-circular cross-sectional ring bands 12 and 13 projecting outwardly along the outer circumferential or peripheral surface of the barrel part 11 at positions B and C and divide the height of said barrel into 3 equal parts. In the present invention, these ring bands 12 and 13 may be advantageously utilized as the annular recesses to which the fixing means is fitted.

Of course, in the present invention, there need not be a plurality of annular recesses as described above but rather only one annular recess is required. In the latter case, the one annular recess is preferably formed at the position A located near the opening of the barrel 11. At the above three positions A, B, and C, or at the four positions, A, B, C and D, with addition of a portion D in the vicinity of the bottom of the barrel 11, annular recesses may be formed thereon at those positions respectively. Alternatively, instead of the above-mentioned annular recesses, band-like pieces of a suitable material (e.g., metal, plastic, or hard rubber) may be fixed to the inside surface of the barrel to form the annular projections or recesses.

The annular projections or recesses may be shaped into substantially perfect annular forms or intermittent annular forms with segments of the circumferential projection eliminated. The cross-sectional shapes of these annular or non-annular projections or recesses may be suitably selected, and various shapes thereof are described later in the relationship with the fixing means c. It should be clear to one skilled in the art that it is necessary to removably fix the fixing means c in a held or engaged state to the projection or the annular recess with the inner bag b being directly or indirectly fixed to the projection or recess. In short, if a later-described inner bag b is set in the container body $a_1$ and the inner bag b is directly or indirectly fixed at the above annular projection or recess 12 or 13, by the later-described fixing means c, the size, sectional shape, number, and the position of the projection or the recess 12 or 13, may be selected with regard to a range of performance determined by the function of the container, for example to prevent the inner bag b from collapsing and slipping down into the container body $a_1$ while the container is filled with liquid inside the inner bag b or during the transit of the container after the filling or while stirring or taking out the liquid contents for use. Additionally, the particular design and location of the projections may be selected in consideration of the method utilized for forming the projection or the recess.

An opening 14 is provided at the one end of the barrel 11 and a portion 15 is the bottom end thereof. Depending on the functional requirements of the barrel 11, there may be provided a single or plural projections 16 located on the inside of the barrel 11 near the bottom thereof along the circumferential surface thereof, as shown in FIG. 3. These projections 16 are in contact with the inner bag b which is wedged inside the barrel 11, and are particularly effective for preventing the twisting of the inner bag during a stirring of the liquid contents, for preventing the bottom of the inner bag from deforming due to the pump suction during the pumping of the liquid by the pump, and for also preventing the inner bag from separating from the container body when the liquid is dumped from the bottom part by tilting or upsetting the container. In this case, a recess may or may not be provided in the inner bag portion at that position adjacent to above the projection 16.

The lid $a_2$ comprises a body 17, a plastic sheet 18 fixed over the entire inner surface thereof, and a ring packing 19 disposed at the outer peripheral part of the body 17 so as to make it possible to sealably seal the container body $a_1$ so as to be air-tight. The sheet 18 is removably fixed to the body 17 so as to permit replacement when soiled.

The fixing of the sheet 18 may be made by applying the sheet 18 to the body 17 and inserting a packing 19 into the peripheral bent portion of the body 17. Other fixing means may be used, for example the sheet 18 may be bonded to the body 17 by a method that utilizes adhesive or heat so as to permit easy peeling, or a sheet 18, molded in advance to conform to the profile of the inner surface of the body 17, may be fixed with the packing 19, or a one-piece molding of the sheet 18 and the packing 19 may be utilized.

Further for fixing, still other means may be utilized. Preferably there may be used, a structure as shown in FIG. 4(*a*). A sheet 18 is provided with plural slits 20 and/or notches 21 made by removing part of the sheet which are aligned with the packing 19. With this above structure, it becomes possible to fix the sheet 18 and the packing 19 simultaneously to the body 17 with an adhesive.

The air-tight fixing of the lid $a_2$ to the container body $a_1$ may be carried out by positioning the packing 19, fixed on the body 17 at the open end 14 of the barrel 11, and by applying a band (not illustrated) to the container body $a_1$ and the lid $a_2$ according to the ordinary method known to those skilled in the art. By this means the lid $a_2$ can be removably fixed to the container body $a_1$.

The inner bag b, which can be removably set in the above-described container body $a_1$ includes a tubular body 23 with an integral bottom 22. The body 23 has a size and shape such that it fits into the container body $a_1$. When situated in the container body $a_1$ the tubular body 23 is of such a height that a portion thereof substantially protrudes from the open end of the container $a_1$. The protruding portion can be comprised of a single sheet layer and is open ended. In one embodiment as shown in FIG. 1 and FIG. 2 a single sheet layer protruding portion 25 with an opening 24 at the end thereof is situated in the container body $a_1$.

As shown in FIG. 2, the protruding portion 25 may have a suitable length so that it can be turned down over the outside of the barrel 11 when the inner bag b is set inside the container body $a_1$. Also the portion 25 may be of a length so as to allow for a label for identification of the liquid to be placed thereon. By the above arrangement, soiling of the part of the outside of the barrel 11 covered with the turned down portion by the filled liquid can be prevented. Also, the pressure exerted on the part of the protruding portion abutting the lid $a_2$ when it is fitted to the container body $a_1$, serves to further fix the inner bag b to the container body $a_1$.

The inner bag b shown in FIG. 1 and FIG. 2 illustrates the case in which the protruding portion 25 is formed in a single layer, the embodiments shown in FIG. 5 and FIG. 6 illustrate the cases in which the protruding portions 25 are formed in double or triple layers. In FIGS. 5 and 6, the protruding portion 25 is part of an outside layer of the bag b and similarly a part of an inside layer of the bag b is a protruding portion 27 which has the same or a slightly smaller diameter than the body 23 and has an opening 26 therein. The inside protruding portion 27 makes it possible to seal the inner bag b while situated in the container body $a_1$ by closing it with a suitable means (e.g., a clip or a cord). In closing the inner bag, a cap (not illustrated) having a removable sealing lid may be used. Thus, by providing an inside protruding portion 27 in combination with the lid $a_2$, the container filled with liquid can be doubly sealed. For example, when the liquid is a coating composition, it is possible to seal an inert gas (e.g., nitrogen gas) within the inner bag b to prevent skinning or evaporation thereof, and the sealing is also effective in preventing a change in quality of the filled liquid.

In addition to the above double protruding portions 25 and 27 of the inner bag, another protruding portion 30 has an opening 29 and is situated within the container like the other layers. This protruding portion 30 may have a length just sufficient to cover the opening end 14 of barrel 11, by which damage of the outside protruding portion 25 caused by the irregular surface flaws of the open end 14 can be prevented. Of course, only the two layers with protruding portions 25 and 30 may be provided in combination.

The inner bag b having the above construction comprises a plastic film. Because it is removably fitted in the container body $a_1$, it is required to have a certain degree of elasticity. Also, if thermal deformation or thermal melting is required, the use of a thermoplastic film like polyethylene, polypropylene, polyester, nylon, etc. or a compound film thereof is suitable as a material for the inner bag. Depending on the property of the liquid to be put into the container, a compound film made by compounding the above-mentioned film with another material (e.g., paper, cloth, metal foil) which may be used as necessary. Since the protruding portions 25, 27 and 30 are either folded back or closed in the center of the top of the drum, they should desirably have greater elasticity. The film thickness at each part of the inner bag b may be optionally selected within a range according to the respective functional requirements. For example, in employing a high density polyethylene film as a material for the inner bag b to be used with a full removable head steel drum (200 l) of the present embodiment, there may be used a film of about 250$\mu$ thick for the body 23 and the protruding portion 30, a film of about 800$\mu$ thick for the bottom 22, and a film of about 70$\mu$ thick for the protruding portions 25 and 27, respectively. An inner bag b with a bottom of thick film of hard quality is effective for preventing the inner bag b from being pulled about during a stirring of the filled liquid or for preventing deformation of the bottom due to the suction force associated with pumping out the filled liquid with a pump. In the case of using the materials having different film thicknesses, the materials may be bonded together by means of a bonding agent or heat according to the usual method known to those skilled in the art. Of course, the inner bag having a uniform overall film thickness may be used in the present invention. The sheet 18, fixed to the inner surface of the lid body 17, may be suitably selected from the above-described various films. For example, a polyethylene film of the same quality as above having a thickness of about 70$\mu$ may be used.

The fixing means c to fix the inner bag b to the inside of container body $a_1$ can be one of 3 kinds of embodiments as shown in the parts of FIG. 7, when the recess 12 is formed on the container body $a_1$.

Firstly, the embodiment shown in FIG. 7(*a*) is a form wherein the inner bag body 23 is in a position which corresponds to the recess 12 of the container $a_1$ and is deformed by heat, according to conventional method, to form a projection 31 which can be removably fitted to the recess 12. In order to maintain the shape of this projection 31, it is advantageous to fix an auxiliary means 32 in the inside thereof.

The embodiment shown in FIG. 7(*b*) has a projecting member 33 fitted to the outer surface of the inner bag body 23 at the fixed position corresponding to the recess 12 of the container body $a_1$, said member 33 being removably fitted to the recess 12.

As shown in FIGS. 7(*a*) and (*b*), the projection 31 or the projecting member 33 respectively, comprises the fixing means c which fixes the inner bag b, and the fixing means c is directly fixed to the recess 12 of the container body $a_1$, thereby fixing the inner bag b to the container body $a_1$. To the contrary, the embodiment shown in FIG. 7(*c*) employs an independent means 34 which can be removably fixed to the recess 12 of the container body $a_1$ from the inside of the inner bag b. In other words, the member 34 is a means of indirectly fixing the inner bag b to the recess 12 of the container body $a_1$ whereby the bag b is situated between the member 34 and the recess.

The configurations of these fixing means 31, 33 and 34 with respect to their sectional shapes must conform with the configuration of the recess 12 of the container body $a_1$ such that the fixing means must fixedly contact the inside of said recess to hold the means and the inner bag b and yet the fixing means must disengage from the recess 12 when a positive exertion of force for taking out the fixing means is applied thereto. Accordingly, it is advantageous to select the fixing means c so as to maintain the adequate fixing and disengagement condition as described above based on the cross-sectional shape of the recess 12 of the container body $a_1$.

When the fixing means is of the above-described type as shown in the parts of FIG. 7, it is advantageous to use the fixing means 31, 33 and 34, each of which has resilient or spring force characteristics which can cause the fixing means to function to press itself, with or without the inner bag b, into the recess 12 of the container body $a_1$. To this end, for example, the fixing means 34 may be used in a state whereby an annular spring means thereof is partially notched and is compressed. In this case, the notched portion may be provided with a freely slidable coupling (not illustrated) so as to configure the fixing means 34 into fully annular form.

With regard to the fixing means 33 and the auxiliary means 32, the means may have an elastic hollow annular means wherein a partially cut spring annular means, similar to the above fixing means 34, is inserted into the hollow portion. Of course, this combination may be used as the fixing means 34. Accordingly, when using such fixing means 31, 33 or 34 as a fixing means c, it is desirable for the corresponding recess of the container body $a_1$ to be fully annular. The fixing means c, especially the fixing means 34 which is in direct contact with the liquid, is made of a material which does not dissolve etc. and therefore does not effect to the quality of the liquid. Examples of such material are metal (steel, stainless steel, etc.), plastics, etc.

An above fixing means c is not necessarily required for each recess of the container body $a_1$ but a single one may be provided for one recess. In this case, it is desirable to use the fixing means for the recess located at the position A nearest the opening of the container body $a_1$. In case of the arrangement of the plural number of fixing means c, various fixing means shown in FIG. 7 may be used. Also, one kind or a combination of kinds may be used. In case of a multiple number of the fixing means 34, they may be independent or, as shown in FIGS. 8(*a*) and (*b*), mutually connected by means of a suitable member 40, and, as shown in 8(*c*) and (*d*), supported by the member 41 from the bottom of the inner bag b.

When projections are formed on the container body $a_1$, the fixing means c with a recess formed section is used, said recess is shaped in a manner contrary to the case where the container body $a_1$ has a recess and the fixing means c has a projection as previously described.

According to the container of the present invention comprising the above construction, it is possible to prevent the inner bag from slipping out from the container so as to prevent the unexpected soiling of the inner surface of the container by the contained liquid when the liquid such as coating composition or ink is put into the container or while the liquid is carried after the filling or while being stirred or being taken out for use. Additionally, a part of the outside surface of the container and the inside face of the lid are also kept from being soiled by the abovementioned liquid. Accordingly, the regeneration of the container for the purpose of re-use is simplified. The regeneration according to the present invention, although requiring the replacement of the inner bag and the inside cover of the lid, is advantageous in comparison with conventional regeneration methods with respect to work steps and work cost. In regeneration of a container of the present invention, the container need not be subjected to so vigorous regenerating conditions such as those required in conventional processes. Thus, the present invention is advantageous in that the less vigorous required regeneration cycle allows the container to last longer. This is not only the case when the containers are used for coating composition, ink, etc. but also is the case when the containers are used as stirring tanks or the like by the consumers. Because the inner bag within the container of the present invention is not separated from the container body by the stirring of the filled liquid as described above, there is also the advantage that the container can be used for such a purpose. Since the liquid is not directly in contact with the container (made mainly of metal) and in fact is sealed from the container by the inner bag, the container of the present invention is effective for preventing foreign matters from mixing with the liquid or for preventing change of quality of the liquid by its contact with outside air.

In the above example, explanations are made on the basis of the full removable head steel drum (200 l), but the present invention is not limited in scope thereto but rather covers other containers known to those skilled in the art to be reused by regeneration. Accordingly, when the above container has no such above-described annular recess, one may be provided by a conventional deformation process known to those skilled in the art. Or further instead of the annular recess as described, suitable material (e.g., metal, plastic, hard rubber) may be used to form an annular projection or recess, and a fixing means c which can be removably fitted thereto may be used thereon.

For example, as shown in FIG. 9, the container body $a_1$ is provided near its opening with an annular projection or recess 37 (a projection in the drawing) which is suitable for removably fitting the fixing means, by the use of the above material. The fixing means c is an annular member 38 with a recess and comprising a suitable material (e.g., plastic, rubber) which can be removably fitted to the above projection 37 while an inner bag b is situated therebetween. The inner bag b is required to have some amount of elasticity for convenience of fitting and removal and therefore must be made of an appropriate material. The illustrated projection 37 may be in full annular form, but is advantageously structured in an intermittent annular form with one curvilinear portion or plural portions thereof cut out, as previously described. Also, because the air existing between the container body $a_1$ and the inner bag b is facilitated in its escape, via outside through the cut part of the projection 37, during the filling of the container, the contact between the container $a_1$ and the inner bag b is improved. The same reasoning will apply in the reverse case where the element 37 is a recess and 38 is a projection.

As shown in FIG. 9, a sheet 39 of material similar to the material used in the sheet 18 for the lid $a_2$ may be provided in the inside space of the annular member 38. The sheet 39 may be provided with a cap having a sealing lid which can be freely fitted and detached. Said sheet 39 may have a pull-open type inner lid. By adopting the combination of the annular member 38 and the sheet 39, the liquid can be doubly sealed from the container without the use of the above-mentioned inside protruding portion 27 of the inner bag b.

In the case of using a lid with a small diameter injection port located therein and with a sealable cap as shown in FIG. 4(*b*) or (*c*), a sheet 18' may be used therewith. The sheet 18' shown in FIG. 4(*b*) has a tubular member 35 which can be inserted into the injection port of the above lid body. After charging a liquid through this tubular member 35, it may be sealed and pushed inside, and then the injection port of the lid body 17 sealed with a cap. The sheet 18'' shown in FIG. 4(*c*) has itself a cap 36 provided with a lid for sealing. It may be used in the same manner as in the above-described sheet 18'. In case of using the above sheets 18' or 18'', the inside protruding portion 27 and the sheet 39 can be omitted.

As described above, according to the container for holding liquid of the present invention, the inner bag can be securely set in and fixed to the container. Thus the soiling of the inside face of the container by the liquid held in the container can be prevented, and, at the time of the re-use of the container, the inner bag can be simply replaced by a new one. Accordingly, the container of the present invention is suitable for sealably holding a liquid such as a coating composition or an ink, which when held in a prior art container leaves deposits on the inner surface thereof that are extremely hard to remove.

We claim:

1. A container for holding liquids, said container comprising:

a rigid cylindrical main body, said main body having an open end, a fixed end member sealing one end of said main body, a plurality of annular ring retaining means extending around the inner periphery of said main body, each means being taken from the group consisting of an annular groove in the cylindrical portion of said main body and a projection, said plurality of said means being spaced from each other axially in the direction of the central longitudinal of said main body, at least one of said means being adjacent the open end of said main body;

a plastic inner bag removably positioned inside said main body and having a protruding open end portion projecting out of said main body open end when said bag is positioned inside said main body and folded downwardly around the outer periphery of said main body;

a plurality of resilient ring members each removably positioned within said main body, one engaged with said inner bag and with said retaining means adjacent the open end of said main body, and at least one further ring member engaged with said inner bag and with a further retaining means spaced inwardly from said open end of said main body;

a longitudinal member which is attached to and connects said ring members together; and a lid removably fitted to said open end of said main body.

2. A container for holding liquids, said container comprising:

a rigid cylindrical main body, said main body having an open end, a fixed end member sealing one end of said main body, and a plurality of annular ring retaining means extending around the inner periphery of said main body, each means being taken from the group consisting of an annular groove in the cylindrical portion of said main body and a projection, said plurality of said means being spaced from each other axially in the direction of the central longitudinal axis of said main body, at least one of said means being adjacent the open end of said main body;

a plastic inner bag removably positioned inside said main body and having a protruding open end portion projecting out of said main body open end when said bag is positioned inside said main body and folded downwardly around the outer periphery of said main body;

a plurality of resilient ring members each removably positioned within said main body, one engaged with said inner bag and with said retaining means adjacent the open end of said main body, and at least one further ring member engaged with said inner bag and with a further retaining means spaced inwardly from said open end of said main body;

a support member resting against said main body fixed end member and connected to and supporting at least one of said ring members; and a lid removably fitted to said open end of said main body.

3. A container as claimed in claim 2 in which said support member is connected to and supports the innermost of said ring members.

4. A container for holding liquids, said container comprising:

a rigid cylindrical main body, said main body having an open end, a fixed end member sealing one end of said main body, and a plurality of annular ring retaining means extending around the inner periphery of said main body, each means being taken from the group consisting of an annular groove in the cylindrical portion of said main body and a projection, said plurality of said means being spaced from each other axially in the direction of the central longitudinal axis of said main body, at least one of said means being adjacent the open end of said main body;

a plastic inner bag removably positioned inside said main body and having a protruding open end portion projecting out of said main body open end when said bag is positioned inside said main body and has an outer and an inner layer integral with the remainder of said bag, said outer layer being folded downwardly and around a portion of the outer periphery of said main body and said inner layer being drawn together and secured at the center of said open end of said main body for closing the inside of said inner bag;

a plurality of resilient ring members each removably positioned within said main body, one engaged with said inner bag and with said retaining means adjacent the open end of said main body, and at least one further ring member engaged with said inner bag and with a further retaining means spaced inwardly from said open end of said main body; and a lid removably fitted to said open end of said main body.

5. A container for holding liquids, said container comprising:

a rigid cylindrical main body, said main body having an open end, a fixed end member sealing one end of said main body, and a plurality of annular ring retaining means extending around the inner periphery of said main body spaced axially in the direction of the central longitudinal axis of said main body, at least one of said means being adjacent the open end of said main body;

a plastic inner bag removably positioned inside said main body and having a protruding open end portion projecting out of said main body open end when said bag is positioned inside said main body and folded downwardly around the outer periphery of said main body;

a plurality of resilient ring members each removably positioned within said main body, one engaged with said inner bag and with said retaining means adjacent the open end of said main body, and at least one further ring member engaged with said inner bag and with a further retaining means spaced inwardly from said open end of said main body; and a lid removably fitted to said open end of said main body, the surface of said lid facing the inside chamber of said main body being adapted to receive an annular removable packing around its outer peripheral surface and is lined with a removable plastic sheet, said plastic sheet having perforations around segments of its outer peripheral surface aligned with said packing, the packing being applied to said lid with said plastic sheet between the packing and the lid with adhesive securing the portions of the packing exposed through said perforations to said lid.

* * * * *